US008529033B2

(12) United States Patent
Ishibe

(10) Patent No.: US 8,529,033 B2
(45) Date of Patent: Sep. 10, 2013

(54) LIQUID SUPPLY SYSTEMS

(75) Inventor: Akinari Ishibe, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 314 days.

(21) Appl. No.: 12/830,281

(22) Filed: Jul. 2, 2010

(65) Prior Publication Data

US 2011/0001781 A1 Jan. 6, 2011

(30) Foreign Application Priority Data

Jul. 3, 2009 (JP) ..... 2009-158405

(51) Int. Cl.
*B41J 2/175* (2006.01)

(52) U.S. Cl.
USPC ..... 347/86; 347/49; 347/85

(58) Field of Classification Search
USPC ..... 347/85–89, 49
See application file for complete search history.

(56) References Cited

U.S. PATENT DOCUMENTS 6,502,917 B1 * 1/2003 Shinada et al. ..... 347/19
8,007,091 B2 * 8/2011 Nakamura et al. ..... 347/86
2004/0196333 A1 * 10/2004 Yoshiyama et al. ..... 347/49
2007/0247499 A1 * 10/2007 Anderson et al. ..... 347/86
2007/0279464 A1 * 12/2007 Harazim ..... 347/86
2007/0296775 A1 * 12/2007 Lee et al. ..... 347/86
2008/0158318 A1 * 7/2008 Asauchi ..... 347/86
2008/0204529 A1 * 8/2008 Matsumoto et al. ..... 347/86
2009/0135237 A1 5/2009 Nakamura et al.
2009/0141102 A1 6/2009 Takagi

FOREIGN PATENT DOCUMENTS

JP 2005-288866 A 10/2005
JP 2008-194885 A 8/2008
JP 2009-132115 A 6/2009

* cited by examiner

*Primary Examiner* — Ellen Kim
(74) *Attorney, Agent, or Firm* — Baker Botts L.L.P.

(57) ABSTRACT

A liquid supply system has a liquid cartridge that supplies liquid, a cartridge mounting portion, and an urging member. The liquid cartridge is removably mounted to the cartridge mounting portion, and the urging portions urges the liquid cartridge in a demounting direction when the liquid cartridge is mounted. The cartridge mounting portion includes a bottom plate having a first surface extending in a first direction parallel to the demounting direction and a second surface that borders the first surface and extends from the first surface in a second direction. An angle formed between the second direction and a downward vertical direction is less than an angle formed between the first direction and the downward vertical direction.

17 Claims, 8 Drawing Sheets

LIQUID SUPPLY SYSTEMS

CROSS REFERENCE TO RELATED APPLICATION

The present application claims priority to and the benefit of Japanese Patent Application No. 2009-158405, which was filed on Jul. 3, 2009, the disclosure of which is incorporated herein by reference in its entirety.

BACKGROUND OF THE INVENTION

1. Field of the Invention

The present invention relates to liquid supply systems configured to supply liquid.

2. Description of the Related Art

A known liquid supply system has a liquid cartridge that stores liquid, and a cartridge mounting portion. The liquid cartridge is configured to be mounted to the cartridge mounting portion in a mounting direction. Liquid is supplied to a supply destination from the liquid cartridge positioned in a mounted position in the cartridge mounting portion. The cartridge mounting portion or the liquid cartridge has an urging member configured to urge the liquid cartridge in a demounting direction, which is opposite to the mounting direction.

For example, another known liquid cartridge has a supply portion having a supply path formed therethrough, and liquid stored in the liquid cartridge is supplied to the outside of the liquid cartridge through the supply path. If the supply path always communicates with the outside of the liquid cartridge, then the liquid flows out through the supply path even when it is not intended. Therefore, in order to allow the liquid to be supplied to the outside of the liquid cartridge only when the liquid cartridge is positioned in the mounted position in the cartridge mounting portion, the known supply portion has a valve mechanism including a valve capable of selectively opening and closing the supply path and a spring urging the valve in a direction for the valve to close the supply path. When the liquid cartridge is mounted to the cartridge mounting portion in the mounting direction, the valve is moved against the urging force applied by the spring of the valve mechanism, such that the spring contracts and the valve opens the supply path, the supply path is brought into communication with a liquid path formed in the cartridge mounting portion, and the liquid can be supplied from the supply path into the liquid path. Thus, when the liquid cartridge is in the mounted position of the cartridge mounting portion, the liquid cartridge is urged in the demounting direction, opposite to the mounting direction, by the force of the contracted spring.

Hence, the cartridge mounting portion has a locking mechanism configured to retain the liquid cartridge in the mounted position against the urging force of the spring. When the liquid cartridge retained by the locking mechanism is released, the liquid cartridge ejects out of the cartridge mounting portion due to a kinetic energy produced by the urging force of the spring and transferred to the liquid cartridge. If the liquid cartridge that has jumped out of the cartridge mounting portion falls over, liquid may splash out of the liquid cartridge.

In another known liquid supply system, to allow a user to readily remove a liquid cartridge from a cartridge mounting portion, an urging member configured to urge the liquid cartridge in the demounting direction is positioned in the cartridge mounting portion. When a plurality of liquid cartridges are placed side by side in the cartridge mounting portion, it may be difficult to demount only one of those liquid cartridges from the cartridge mounting portion because the presence of the cartridges adjacent thereto hinders the demounting. With the urging member urging the liquid cartridge in the demounting direction, however, only the liquid cartridge that the user intends to demount can be moved in the demounting direction, such that the liquid cartridge becomes offset from the other liquid cartridges in the demounting direction. Nevertheless, if the liquid cartridge is moved and completely comes out of the cartridge mounting portion, the liquid cartridge that has come out may fall over and liquid may splash out of the liquid cartridge and taint the environment.

In a known inkjet recording apparatus, e.g., the inkjet recording apparatus described in Patent Application Publication No. JP 2005-288866 A, an elastic member is provided in a bottom plate of a cartridge mounting portion. The elastic member has a hook and is bendable. During mounting of an ink cartridge to the cartridge mounting portion, the bottom surface of the ink cartridge comes into contact with the hook, and the elastic member bends. When the ink cartridge is locked or retained at a mounted position, the elastic member has returned to its original position from the bended position, and the hook is positioned in a recess provided in the bottom surface of the ink cartridge. When the demounting of the ink cartridge from the cartridge mounting portion is attempted, the ink cartridge moves to jump out of the cartridge mounting portion by being urged by an urging member in the demounting direction. Nevertheless, because the hook comes into contact with an end of the recess of the ink cartridge, the movement of the ink cartridge is restricted, which prevents the ink cartridge from jumping out of the cartridge mounting portion.

Nevertheless, when the ink cartridges are mounted to and demounted from the cartridge mounting portion repeatedly, the elastic member may become fatigued and may not return to its original position from the bended position. If the elastic member remains in the bended position, the hook may not be able to come into contact with the end of the recess of the ink cartridge even if the ink cartridge is moved in the demounting direction by the urging force of the urging member. Consequently, the movement of the ink cartridge may not be restricted, and the ink cartridge may jump out of the cartridge mounting portion.

In another known liquid supply system, e.g., the ink supply system described in Patent Application Publication No. US 2009/0135237 A1, a cartridge mounting portion has a locking arm configured to retain an ink cartridge by coming into contact with the ink cartridge placed in a mounted position in the cartridge mounting portion. When a user presses down an operation lever of the locking arm, the locking arm pivots in a direction, such that the ink cartridge becomes released, and a stopper of the locking arm is moved to such a position as to come into contact with the ink cartridge moved by an urging member and thus to restrict the movement of the ink cartridge. Nevertheless, if the lever of the locking arm is not sufficiently pressed down by the user, the locked ink cartridge may be released, but the stopper of the locking arm may not reach such a position as to contact the ink cartridge being moved by the urging member. In such a case, the movement of the ink cartridge may not be restricted, and the ink cartridge may jump out of the cartridge mounting portion.

SUMMARY OF THE INVENTION

Therefore, a need has arisen for liquid supply systems which overcome these and other shortcomings of the related art. A technical advantage of the present invention is that chances of a liquid cartridge jumping out of a cartridge mounting portion are reduced.

In an embodiment of the invention, a liquid supply system comprises a liquid cartridge comprising a liquid chamber configured to store liquid therein, a cartridge mounting portion, wherein the liquid cartridge is configured to be removably mounted to the cartridge mounting portion in a mounting direction, and an urging member positioned in one of the liquid cartridge and the cartridge mounting portion and configured to urge the liquid cartridge in a demounting direction opposite to the mounting direction when the liquid cartridge is positioned in a mounted position in the cartridge mounting portion, wherein the liquid cartridge is configured to supply liquid stored in the liquid chamber to the cartridge mounting portion in the mounted position. The cartridge mounting portion comprises a bottom plate comprising a first surface extending from a front end of the first surface to a rear end of the first surface, in the mounting direction, of the first surface in a first direction parallel to the demounting direction, wherein the first surface is configured to support the liquid cartridge and a second surface that borders the first surface and extends from the second end of the first surface in a second direction, wherein an angle formed between the second direction and a downward vertical direction is less than an angle formed between the first direction and the downward vertical direction.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-8B, like numerals being used for like corresponding parts in the various drawings.

Figure 1:
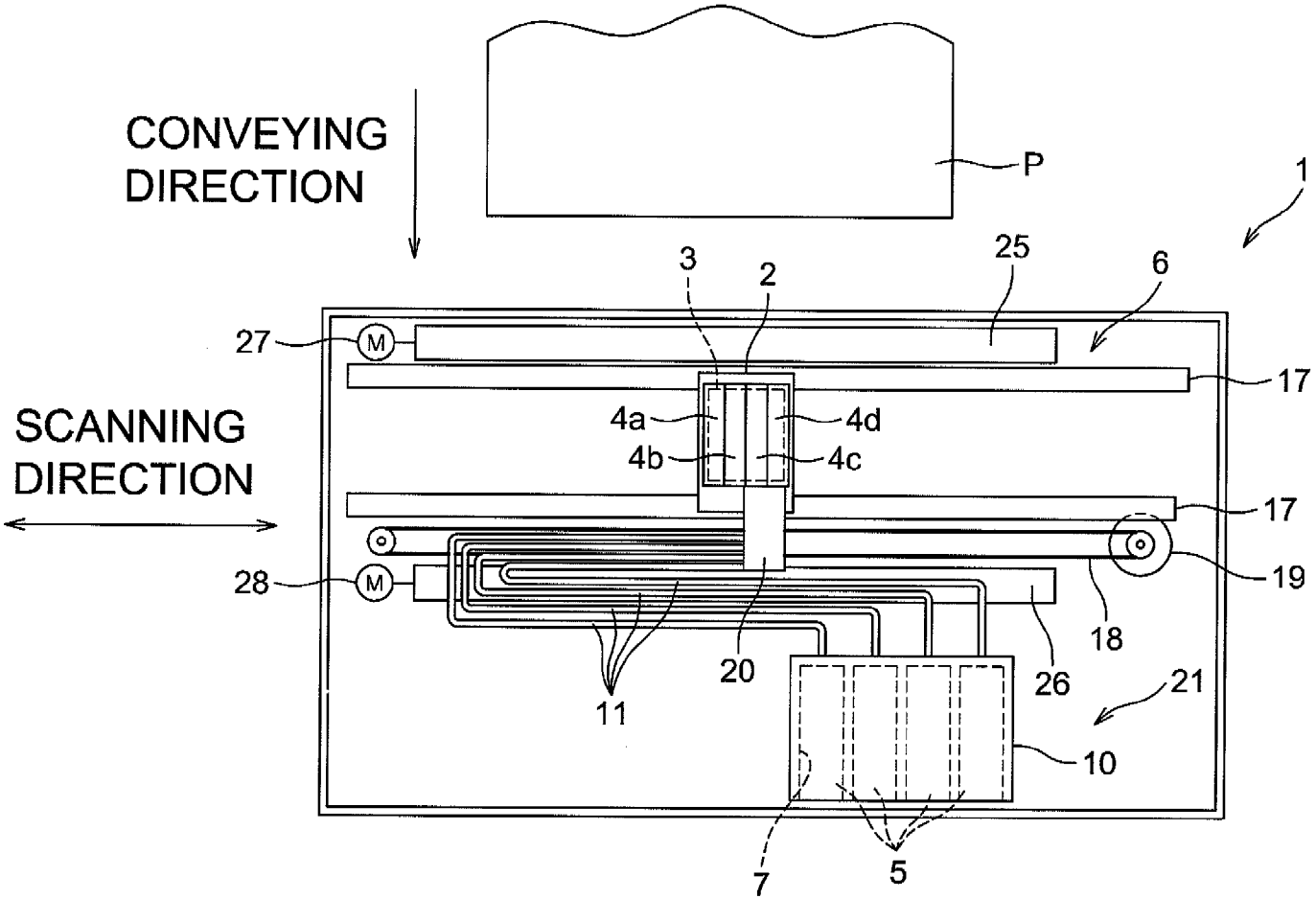
FIG. 1 is a schematic top view of a printer according to an embodiment of the invention.

Referring to FIG. 1, a printer 1 comprises a carriage 2 configured to reciprocate in a scanning direction, e.g., the lateral direction when the printer is positioned as shown in FIG. 1, an inkjet head 3 and sub-tanks 4*a* to 4*d* mounted on the carriage 2, an ink supply system 21, as an example of a liquid supply system, comprising cartridge mounting portions 7 and ink cartridges 5, as an example of liquid cartridges, storing different color inks, respectively, and configured to be demountably mounted to cartridge mounting portions 7, respectively, a conveyance mechanism 6 configured to convey a recording sheet P in a conveying direction that is perpendicular to the scanning direction.

The carriage 2 may be configured to reciprocate along two guide shafts 17 extending substantially parallel to the scanning direction. An endless belt 18 may be connected to the carriage 2. When the endless belt 18 is driven to run by a carriage drive motor 19, the carriage 2 may move in the scanning direction with the running of the endless belt 18.

The carriage 2 may carry the inkjet head 3 and the four sub-tanks 4*a* to 4*d*. The inkjet head 3 may have a number of liquid ejection nozzles formed in the bottom face thereof, e.g., the face hidden behind in FIG. 1. The four sub-tanks 4*a* to 4*d* may be arranged side by side in the scanning direction. A tube joint 20 may be integrally positioned with the four sub-tanks 4*a* to 4*d*. The four sub-tanks 4*a* to 4*d* may be in fluid communication with the four ink cartridges 5, respectively, via flexible tubes 11 connected to the tube joint 20.

The four ink cartridges 5 may be configured to store inks of four colors, for example, black; yellow; cyan; and magenta, respectively. The four ink cartridges 5 may be configured to be mounted to the four cartridge mounting portions 7 positioned in a holder 10 of the ink supply system 21, respectively. The inks of the four colors stored in the four ink cartridges 5 may be supplied to the four sub-tanks 4*a* to 4*d* via the four tubes 11, may be temporarily stored in the sub-tanks 4*a* to 4*d*, and subsequently may be supplied to the inkjet head 3. While the inkjet head 3 reciprocates in the scanning direction together with the carriage 2, the inkjet head 3 may eject inks from a number of the nozzles positioned in the bottom face thereof onto the recording sheet P, conveyed by the conveyance mechanism 6 in the conveying direction.

The conveyance mechanism 6 may comprise a paper feed roller 25 positioned on the upstream side in the conveying direction with respect to the inkjet head 3, and a paper discharge roller 26 positioned on the downstream side in the conveying direction with respect to the inkjet head 3. The paper feed roller 25 and the paper discharge roller 26 may be driven to rotate by a paper feed motor 27 and a paper discharge motor 28, respectively. The conveyance mechanism 6 may be configured to feed the recording sheet P to the inkjet head 3 from the upper side in FIG. 1 by using the paper feed roller 25, and to discharge the recording paper P having an image, characters, and the like recorded thereon by the inkjet head 3 toward the lower side in FIG. 1 by using the paper discharge roller 26.

Figure 2:
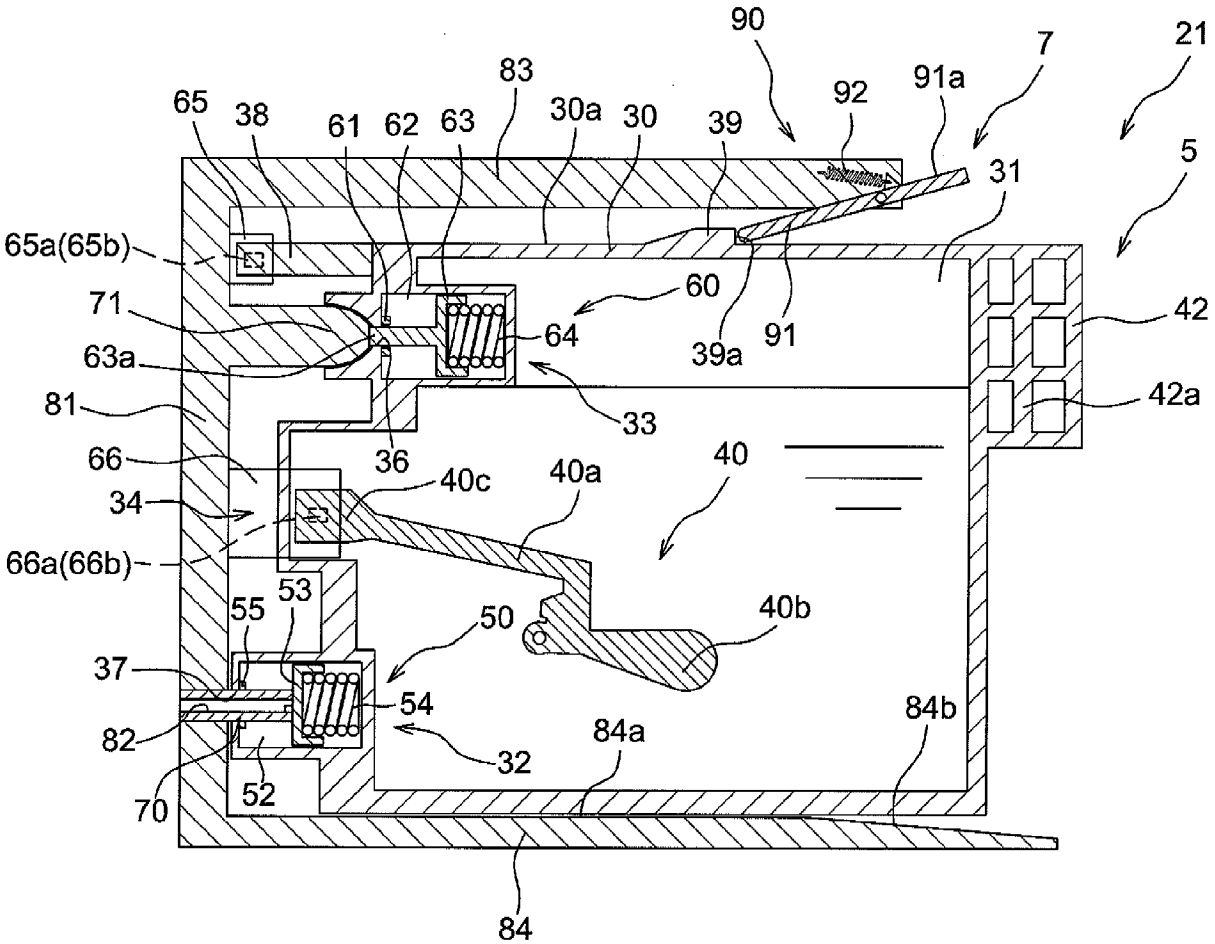
FIG. 2 is a cross-sectional view of an ink supply system taken along a plane that is parallel to a mounting direction and perpendicular to a horizontal plane according to an embodiment of the invention.
Figure 3:
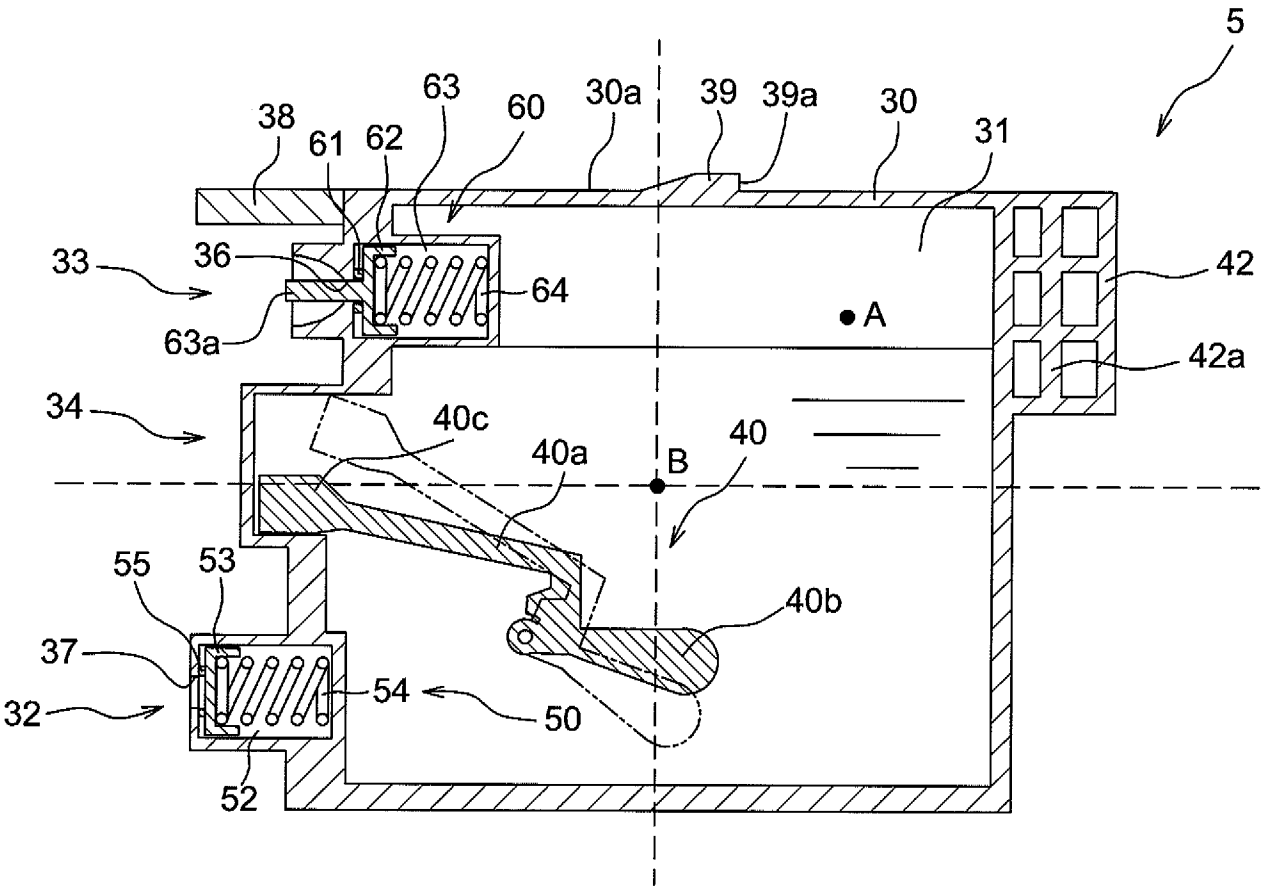
FIG. 3 is a cross-sectional view of an ink cartridge taken along a plane that is parallel to the mounting direction and perpendicular to the horizontal plane according to an embodiment of the invention.
Figure 4:
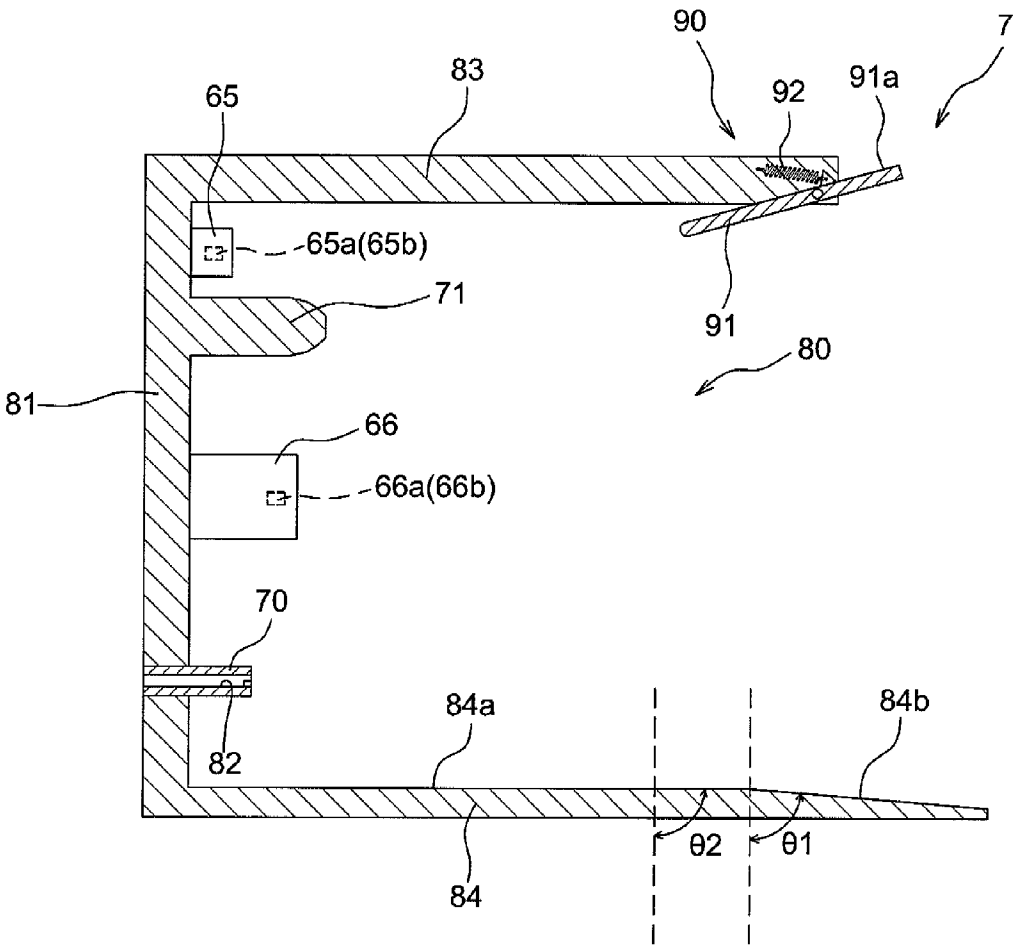
FIG. 4 is a cross-sectional view of a cartridge mounting portion of a holder taken along a plane that is parallel to the mounting direction and perpendicular to the horizontal plane according to an embodiment of the invention.

FIGS. 2 to 4 illustrate the ink supply system 21 comprising the ink cartridges 5 and the holder 10 comprising the cartridge mounting portions 7, according to an embodiment of the invention. The ink cartridge 5 may be configured to be mounted to the cartridge mounting portion 7 of the holder 10 in a mounting direction, and to be demounted from the cartridge mounting portion 7 in a demounting direction which is opposite to the mounting direction. In an embodiment, each of the mounting direction and the demounting direction is a substantially horizontal direction, and therefore, the mounting direction and the demounting direction are substantially parallel to a horizontal plane.

Referring to FIGS. 2 and 3, the ink cartridge 5 may comprise a cartridge body 30 storing ink, and a sensor arm 40 used for determining the amount of ink stored in the cartridge body 30. The cartridge body 30 may be a substantially rectangular-parallelepiped hollow body made of a translucent, e.g., transparent or semi-transparent, material such as a synthetic resin material. The ink cartridge 5 may comprise a projection 38. The projection may extend in the mounting direction from the upper end of the front-end face, in the mounting direction, of the cartridge body 30 when the ink cartridge 5 is positioned in a mounted position in the cartridge mounting portion 7. The projection 38 may comprise a synthetic resin material that does not allow light, e.g., visible or infrared light, to pass therethrough. When the ink cartridge 5 is positioned in the mounted position, the projection 38 may be positioned between a light emitter 65*a* and a light receiver 65*b* of an optical sensor 65 described below. The projection 38 may be configured to block light, e.g., visible or infrared light, emitted from the light emitter 65*a* of the optical sensor 65 toward the light receiver 65*b*. The ink cartridge 5 may be configured to supply ink stored in an ink chamber 31, described in more detail herein, to an ink supply path 82, described in more detail herein, of the cartridge mounting portion 7 when the ink cartridge 5 is positioned in the mounted position.

The ink cartridge 5 may comprise a projection 39. The projection 39 may project upward from a top face 30*a* of the cartridge body 30 near the center of the top face 30*a* in the horizontal direction when the ink cartridge 5 is positioned in the cartridge mounting portion 7. A side face 39*a* of the projection 39 facing in the demounting direction and the top face 30*a* of the cartridge body 30 may form substantially a right angle. The ink cartridge 5 also may comprise a grip 42. The grip 42 may extend in the demounting direction from the upper end of the rear-end face, in the mounting direction, of the cartridge body 30, e.g., from the upper end of the front-end face, in the demounting direction, of the cartridge body 30, when the ink cartridge 5 is positioned in the mounted position in the cartridge mounting portion 7.

The grip 42 may comprise a plurality of ribs 42*a* positioned therein in the form of a lattice. With the ribs 42*a* positioned in the grip 42, deformation of the grip 42 may be suppressed when a user holds the grip 42 with a certain force, e.g., when replacing the ink cartridge 5. The projection 39 and the grip 42 may be formed integrally with the cartridge body 30 by injection molding or the like, or may be formed separately and then may be bonded to the cartridge body 30, e.g., with adhesive or the like. The projection 38 also may be formed integrally with the cartridge body 30. In that case, however, the projection 38 may be made of a translucent material, and the surface of the projection 38 may be covered with a film or the like that does not allow light to pass therethrough.

The ink cartridge 5 may comprise the ink chamber 31 configured to store ink, an ink supply portion 32 configured to supply ink stored in the ink chamber 31 to the outside of the ink cartridge 5, and an air communication portion 33 configured to establish fluid communication between the ink chamber 21 and the outside of the ink cartridge 5, such that air may be introduced into the ink chamber 31. The ink supply portion 32 and the air communication portion 33 may be positioned at the front-end face, in the mounting direction, of the cartridge body 30, and the air communication portion 33 may be positioned above the ink supply portion 32 when the ink cartridge 5 is positioned in the mounted position.

The ink cartridge 5 also may comprise a detection portion 34. The detection portion 34 may project from the front end, in the mounting direction, of the ink chamber 31, and may be positioned between the ink supply portion 32 and the air communication portion 33 when the ink cartridge 5 is positioned in the mounted position in the cartridge mounting portion 7. A light-blocking plate 40*c* of the sensor arm 40 may be positioned in the ink chamber 31, and may be configured to move up and down in the detection portion 34. When the ink cartridge 5 is in the mounted position in the cartridge mounting portion 7, a lower portion of the detection portion 34 may be positioned between a light emitter 66*a* and a light receiver 66*b* of an optical sensor 66, which is described in more detail herein.

The sensor arm 40 may comprise an arm portion 40*a* positioned in the ink chamber 31 and pivotally supported by the cartridge body 30, a float 40*b* positioned at one end of the arm portion 40*a* and configured to move up and down according to the movement of the ink surface in the ink chamber 31, and the light-blocking plate 40*c* positioned at the other end of the arm portion 40*a*. The light-blocking plate 40*c* may be positioned in the detection portion 34 and may be configured to block light, e.g., visible or infrared light, emitted from the light emitter 66*a* toward the light receiver 66*b* of the optical sensor 66 positioned in the cartridge mounting portion 7 when the ink cartridge 5 is positioned in the mounted position in the cartridge mounting portion 7.

The sensor arm 40 may be configured such that, when the float 40*b* moves up and down according to the movement of the ink surface in the ink chamber 31, the light-blocking plate 40*c* connected to the float 40*b* via the arm portion 40*a* may move up and down in the detection portion 34 relative to the cartridge body 30. More specifically, when there is a sufficient amount of ink stored in the ink chamber 31, a large buoyancy acts on the float 40*b*, and a moment in the counter-clockwise direction in FIG. 3 acts on the arm portion 40*a*. Accordingly, as shown by the solid line in FIG. 3, the light-blocking plate 40*c* is in contact with the bottom surface of the detection portion 34. In contrast, when the amount of ink remaining in the ink chamber 31 becomes small and part of the float 40*b* is exposed above the ink surface, the buoyancy acting on the float 40*b* becomes small and, as shown by the chain double-dashed line in FIG. 3, the arm portion 40*a* pivots clockwise in FIG. 3, whereby the light-blocking plate 40*c* comes into contact with the top surface of the detection portion 34.

When the ink surface in the ink chamber 31 moves, the light-blocking plate 40*c* may move with the movement of the float 40*b*, relative to the cartridge body 30. The up-and-down movement of the light-blocking plate 40*c* may be limited by the bottom and top surfaces of the detection portion 34. The ink supply portion 32 and the air communication portion 33 may extend in the mounting direction from portions adjacent to the upper and lower ends of the front-end face, in the mounting direction, of the cartridge body 30, respectively, with the detection portion 34 positioned therebetween, when the ink cartridge 5 is positioned in the mounted position in the cartridge mounting portion 7. The ink supply portion 32 and the air communication portion 33 may be configured such that ink stored in the ink chamber 31 is supplied in the mounting direction through an ink supply path 37 formed through the ink supply portion 32 while air is introduced from the front side, in the mounting direction, of the cartridge body 30. The air may be introduced through an air communication path 36 formed through the air communication portion 33 into the ink chamber 31.

When the ink cartridge 5 is in positioned in the mounted position in the cartridge mounting portion 7 and the ink is being supplied to the outside of the ink cartridge 5, the air communication portion 33 is positioned adjacent to the upper end of the ink chamber 31 and the ink supply portion 32 is positioned adjacent to the lower end of the ink chamber 31. Therefore, air may be introduced smoothly from the air communication portion 33 into an upper space of the ink chamber 31, and ink remaining in a lower space of the ink chamber 31 may be fully supplied.

The ink supply portion 32 may comprise a valve-mechanism-housing chamber 52 configured to house a valve mechanism 50. The valve-mechanism-housing chamber 52 may be configured to communicate with the outside of the ink cartridge 5 through the ink supply path 37. Ink supply path 37 may be formed through a wall defining front end, in the mounting direction, of the valve-mechanism-housing chamber 52. The valve-mechanism-housing chamber 52 may be in fluid communication with the ink chamber 31 and may house the valve mechanism 50 comprising a valve 53, a spring 54, and a sealing member 55. The sealing member 55 may have a substantially annular shape and may be positioned on the inner wall of the valve-mechanism-housing chamber 52 at the front end of the valve-mechanism-housing chamber 52 in such a manner as to surround the ink supply path 37.

The valve 53 may be urged by the spring 54 toward the sealing member 55, such that the valve 53 may contact the sealing member 55, thereby closing the ink supply path 37. When the valve 53 urged by the spring 54 contacts the sealing member 55 and the ink supply path 37 is closed, ink stored in the ink chamber 31 may not be supplied from the ink supply path 37 to the outside of the ink cartridge 5. When the ink cartridge 5 is positioned in the mounted position in the cartridge mounting portion 7, an ink supply tube 70 of the cartridge mounting portion 7 comes into the ink supply path 37 and contacts and pushes the valve 53 against the urging force of the spring 54. When this occurs, the spring 54 may urge the valve 53 in the mounting direction.

The air communication portion 33 may comprise a valve-mechanism-housing chamber 62 configured to house a valve mechanism 60. The valve-mechanism-housing chamber 62 may be configured to communicate with the outside of the ink cartridge 5 through the air communication path 36. Air communication path 36 may be formed through a wall defining a front end, in the mounting direction, of the valve-mechanism-housing chamber 62. The valve-mechanism-housing chamber 62 may be in fluid communication with the ink chamber 31 and may house the valve mechanism 60 comprising a valve 63, a spring 64, and a sealing member 61. The sealing member 61 may have a substantially annular shape and may be positioned on the inner wall of the valve-mechanism-housing chamber 62 at the front end of the valve-mechanism-housing chamber 62 in such a manner as to surround the air communication path 36.

The valve 63 may comprise a projection 63*a* projecting frontward and may be urged by the spring 64 toward the sealing member 61, such that the valve 63 may contact the sealing member 61 with the projection 63*a* positioned in the air communication path 36, thereby closing the air communication path 36. When the valve 63 urged by the spring 64 contacts the sealing member 61 and the air communication path 36 is closed, air may not be introduced from the air communication path 36 into the ink chamber 31. When the ink cartridge 5 is positioned in the mounted position in the cartridge mounting portion 7, a rod 71 of the cartridge mounting portion 7 contacts and pushes the projection 63*a* against the urging force of the spring 64. When this occurs, the spring 64 may urge the valve 63 in the mounting direction.

When the ink cartridge 5 is positioned in the mounted position in the cartridge mounting portion 7 of the holder 10, the ink supply tube 70 is inserted into the ink supply path 37 and pushes the valve 53 in the demounting direction against the urging force of the spring 54. Meanwhile, the rod 71 may push the projection 63*a* of the valve 63, which extends through the air communication path 36, in the demounting direction against the urging force of the spring 64. Then, the valves 53 and 63 may move away from the sealing members 55 and 61, respectively, which may allow ink stored in the ink chamber 31 to be supplied through the ink supply path 37 to the cartridge mounting portion 7, and air to be introduced through the air communication path 36 into the ink chamber 31. When the ink cartridge 5 is positioned in the mounted position in the cartridge mounting portion 7 of the holder 10, the force exerted by the spring 64 in the air communication portion 33 may be greater than the force exerted by the spring 54 in the ink supply portion 32.

Because of the provision of the grip 42 at an upper rear portion, in the mounting direction, of the cartridge body 30 and the provisions of ribs (not shown) positioned in the ink chamber 31, the ink cartridge 5 in the mounted position in the cartridge mounting portion 7 has its center of gravity, shown as Point A in FIG. 3, at a position in rear, in the mounting direction, of a first center line, e.g., the vertical broken line in FIG. 3, of the ink cartridge 5 and above a second center line, e.g., the lateral broken line in FIG. 3 of the ink cartridge 5. The first center line is substantially perpendicular to the mounting and demounting directions and intersects the center of the dimension, e.g., depth, of the ink cartridge 5 in the mounting and demounting directions. The second center line is substantially perpendicular to the vertical direction and intersects the center of dimension, e.g., height of the ink cartridge 5 in the vertical direction.

Moreover, the center of gravity of the ink cartridge 5 may be positioned at a position in rear, in the mounting direction, of a theoretical center of gravity, shown as Point B in FIG. 3, only for the sake of explanation of the ink cartridge 5, which is calculated based on the assumption that the ink cartridge 5 has a homogeneous density over the entirety of the ink cartridge 5. Such a position of the center of gravity of the ink cartridge 5 would apply when the ink cartridge 5 is empty, that is, when there is no ink in the ink cartridge 5. Nevertheless, even in a case where there is some ink stored in the ink cartridge 5, the center of gravity, also taking the weight of the ink into account, is preferably positioned as described above.

Referring again to FIG. 1, the holder 10 may comprise the four cartridge mounting portions 7 aligned in the scanning direction and to which the four ink cartridges 5 are to be mounted. Referring to FIGS. 2 and 4, the cartridge mounting portion 7 of the holder 10 may comprise a front plate 81, a top plate 83 extending from the upper end of the front plate 81 substantially in the demounting direction, and a bottom plate 84 positioned opposite the top plate 83 and extending from the lower end of the front plate 81 substantially in the demounting direction. A cartridge-housing chamber 80 may be defined by the front plate 81, the top plate 83, and the bottom plate 84, and may be formed in the cartridge mounting portion 7. The cartridge mounting portion 7 may have an opening opposite the front plate 81. The ink cartridge 5 may be inserted into the cartridge-housing chamber 80 through the opening toward the front plate 81, in the mounting direction.

The cartridge mounting portion 7 may comprise the optical sensors 65 and 66, the ink supply tube 70, the rod 71, and a locking mechanism 90. The ink supply tube 70 may be positioned adjacent to the lower end of the front plate 81 and extends therefrom in the demounting direction. The ink supply tube 70 may comprise the ink supply path 82 formed therein and extending horizontally. The ink supply path 82 may be in fluid communication with the inkjet head 3 via the flexible tube 11 shown in FIG. 1. The rod 71 may be positioned adjacent to the upper end of the front plate 81 and may extend therefrom in the demounting direction. The optical sensor 66 may be positioned at a vertically center portion of the front plate 81 and may comprise the light emitter 66*a* and the light receiver 66*b*. Light emitter 66*a* and light receiver 66*b* may face each other at a specific predetermined distance in a direction perpendicular to the sheet of FIG. 3. The optical sensor 65 may be positioned at the front plate 81 above the rod 71 and may comprise the light emitter 65*a* and the light receiver 65*b* facing each other at a specific predetermined distance in the direction perpendicular to the sheet of FIG. 3.

The locking mechanism 90 may be positioned at the top plate 83 and may comprise a locking lever 91 extending in one direction and a spring 92. The locking lever 91 may be pivotally supported by the top plate 83 at a position between the front and rear ends of the locking lever 91 in mounting direction. Although the locking lever 91 may be urged by the contracting force of the spring 92 so as to pivot counterclockwise in FIGS. 2 and 4 before the ink cartridge 5 is mounted to the cartridge mounting portion 7, the locking lever 91 may be stopped in a specific position by a stopper (not shown). When the ink cartridge 5 is positioned in the mounted position in the cartridge-housing chamber 80, the locking lever 91 is positioned in a locking position where the locking lever 91 may contact the side face 39*a* of the projection 39 of the ink cartridge 5. The locking lever 91 may comprise an operation portion 91*a* at the rear end, in the mounting direction, of the locking lever 91. The locking lever 91 may be configured to pivot clockwise in FIGS. 2 and 4 when the operation portion 91*a* is pressed downward, whereby the locking lever 91 may be moved to a release position where the locking lever 91 is separated from the side face 39*a* of the projection 39.

Referring to FIG. 4, as shown in a cross-section taken along a plane that is parallel to the mounting direction and perpendicular to a horizontal plane, the top surface of the bottom plate 84 of the cartridge mounting portion 7 may comprise a first surface 84*a* extending from the front end, in the mounting direction, of the first surface 84*a* to the rear end, in a first direction parallel to the demounting direction. The top surface of the bottom plate 84 also may comprise a second surface 84*b* contiguous with the first surface 84*a* and extending from the rear end of the first surface 84*a* in a second direction. An angle θ1 formed between the second direction and the downward vertical direction, e.g., the direction of the gravitational force, is less than an angle θ2 formed between the first direction and the downward vertical direction. In addition, the length of the first surface 84*a* in the first direction is greater than the length of the second surface 84*b* in the second direction.

Figure 5A:
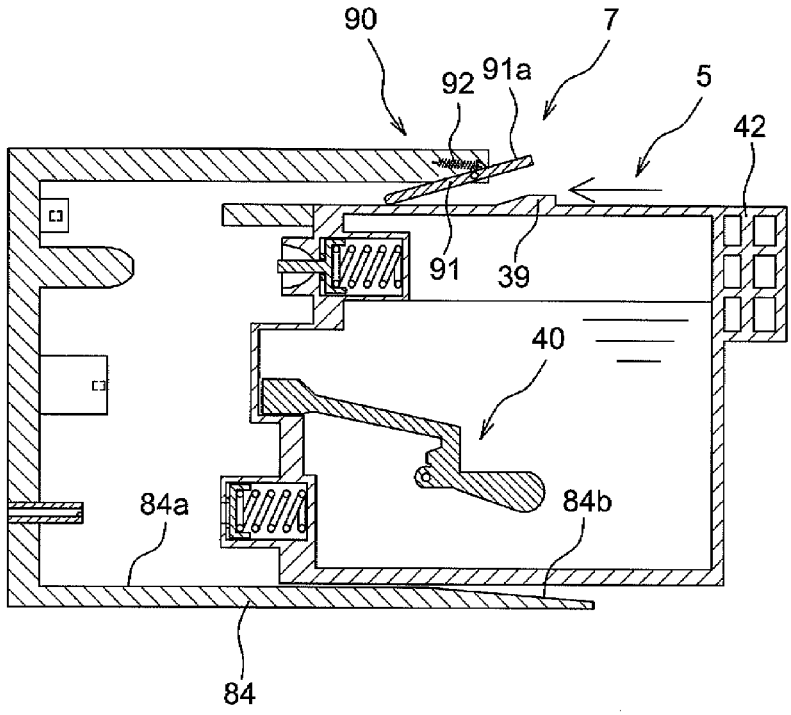
FIG. 5A is a cross-sectional view of the ink supply system taken along a plane that is parallel to the mounting direction and perpendicular to the horizontal plane, during mounting of the ink cartridge to the cartridge mounting portion.
Figure 5B:
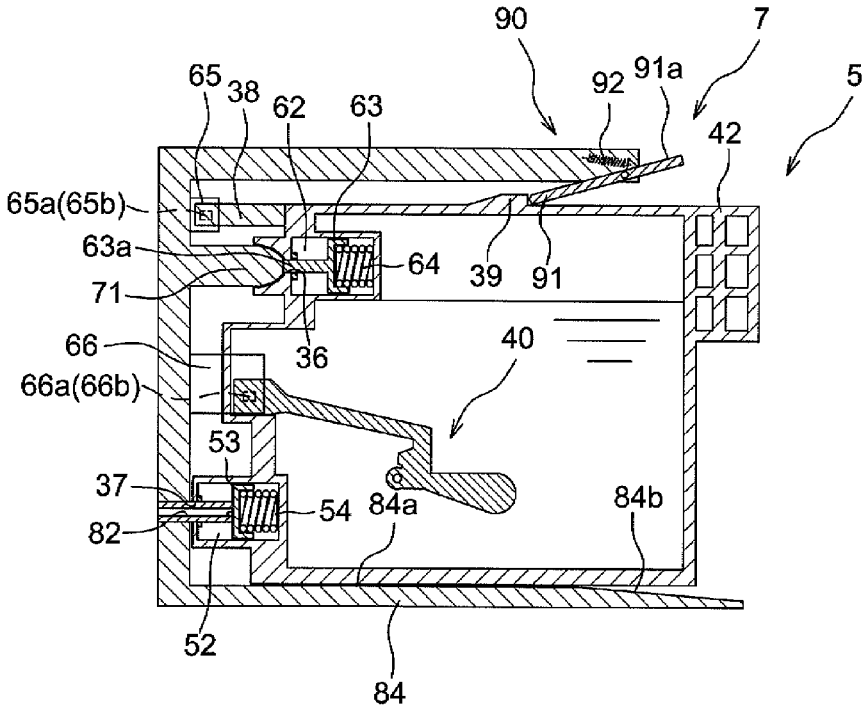
FIG. 5B is another cross-sectional view of the ink supply system taken along a plane that is parallel to the mounting direction and perpendicular to the horizontal plane, in which the ink cartridge is positioned in a mounted position.

FIGS. 5A and 5B, illustrate how the ink cartridge 5 is mounted to the cartridge mounting portion 7 of the holder 10, according to an embodiment of the invention. Referring to FIG. 5A, a user may hold the grip 42 of the ink cartridge 5 and insert the ink cartridge 5 from the opening of the cartridge mounting portion 7 into the cartridge-housing chamber 80. The ink cartridge 5 may be mounted to the cartridge mounting portion 7 in the mounting direction while being supported by the first surface 84*a* of the bottom plate 84 of the cartridge mounting portion 7. During the mounting of the ink cartridge 5 into the cartridge mounting portion, the front end, in the mounting direction, of the locking lever 91 may slide on the top face 30*a* of the ink cartridge 5 and may climb over the projection 39. Because the length of the first surface 84*a* in the first direction of the bottom plate 84 is greater than the length the second surface 84*b* in the second direction, the ink cartridge 5 readily may be mounted in the mounting direction.

Referring to FIG. 5B, when the ink cartridge 5 reaches the mounted position, the front end, in the mounting direction, of the locking lever 91 may contact the side face 39*a* of the projection 39 of the ink cartridge 5, whereby the locking lever 91 locks the ink cartridge 5. That is, the ink cartridge 5 may become unmovable in the demounting direction.

At the same time, the ink supply tube 70 may contact the valve 53 of the ink supply portion 32, and the rod 71 may contact the projection 63*a* of the valve 63 of the air communication portion 33. Then, the valves 53 and 63 may be pushed by the ink supply tube 70 and the rod 71, respectively, causing the springs 54 and 64 to contract, whereby the ink supply path 82 in the cartridge mounting portion 7 may be placed in fluid communication with the valve-mechanism-housing chamber 52, and the air communication path 36 is opened. Consequently, air may be introduced into the ink chamber 31 through the air communication path 36, and the ink stored in the ink chamber 31 may be supplied via the ink supply path 37 of the ink cartridge 5 to the ink supply path 82 in the cartridge mounting portion 7.

Moreover, the projection 38 projecting from the cartridge body 30 may be positioned between the light emitter 65*a* and the light receiver 65*b* of the optical sensor 65. Light emitted from the light emitter 65*a* of the optical sensor 65 may be blocked by the projection 38 and may not be received by the light receiver 65*b*. In contrast, when the ink cartridge 5 is not mounted to the cartridge mounting portion 7, light emitted from the light emitter 65*a* of the optical sensor 65 is received by the light receiver 65*b*. That is, it may be determined whether the ink cartridge 5 has been mounted to the cartridge mounting portion 7 based on whether light emitted from the light emitter 65*a* is received by the light receiver 65*b*.

In addition, the detection portion 34 may be positioned between the light emitter 66*a* and the light receiver 66*b* of the optical sensor 66. When there is more than sufficient amount of ink in the ink chamber 31 for operation, the light-blocking plate 40*c* housed in the detection portion 34 may be in the lowest position where the light-blocking plate 40*c* is in contact with the bottom surface of the detection portion 34. Light emitted from the light emitter 66*a* may be blocked by the light-blocking plate 40*c* in this position and may not be received by the light receiver 66*b*. In contrast, when the amount of ink remaining in the ink chamber 31 is small, the light-blocking plate 40*c* may be in the highest position where the light-blocking plate 40*c* is in contact with the top surface of the detection portion 34. When light-blocking plate 40*c* is in this position, light-blocking plate 40*c* does not block light emitted from the light emitter 66*a*, and light receiver 66*b* may receive the emitted light. That is, based on whether light emitted from the light emitter 66*a* is received by the light receiver 66*b*, it may be determined whether the amount of ink remaining in the ink chamber 31 is larger or smaller than a predetermined specific amount. The specific amount may indicate a near-empty state of the ink cartridge 5 where the amount of ink remaining in the ink chamber 31 is small and the ink cartridge 5 will soon need to be replaced.

Figure 6A:
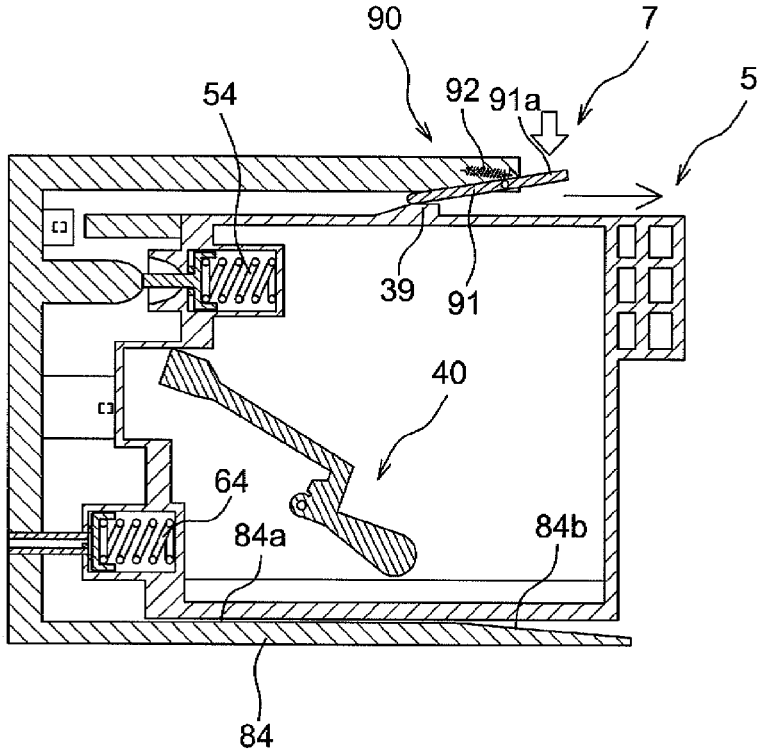
FIG. 6A is a cross-sectional view of the ink supply system taken along a plane that is parallel to the mounting direction and perpendicular to the horizontal plane immediately after a locked ink cartridge is released.
Figure 6B:
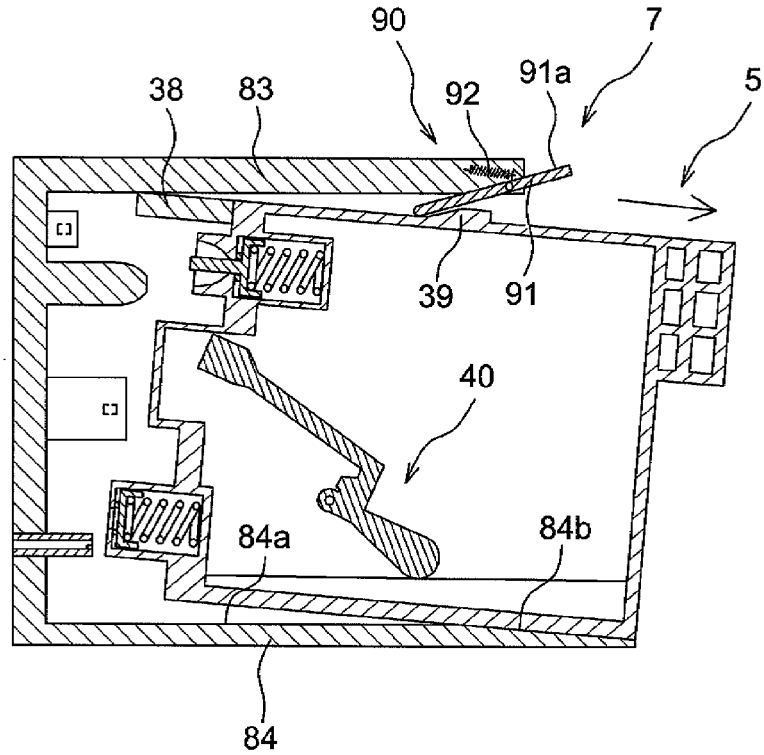
FIG. 6B is another cross-sectional view of the ink supply system taken along a plane that is parallel to the mounting direction and perpendicular to the horizontal plane some time after the locked ink cartridge is released.

FIGS. 6A and 6B illustrate how the ink cartridge 5 is demounted from the cartridge mounting portion 7. In the following, the ink cartridge 5 in the near-empty state is demounted from the cartridge mounting portion 7. When a user presses down the operation portion 91*a* of the locking lever 91, the front end, in the mounting direction, of the locking lever 91 that has been in contact with the side face 39*a* of the projection 39 of the ink cartridge 5 may be moved upward, whereby the ink cartridge 5 locked by the locking lever 91 may be released, allowing the ink cartridge 5 to be moved in the demounting direction.

Referring to FIG. 6A, when the user has operated operation portion 91*a* of the locking lever 91, the ink cartridge 5 in the mounted position in the cartridge-housing chamber 80 may be pushed out in the demounting direction by the urging forces of the expanding springs 54 and 64, whereby the ink cartridge 5 may move in the demounting direction along the first surface 84*a* of the cartridge mounting portion 7 due to a kinetic energy produced by the urging forces of the springs 54 and 64 and transferred to the ink cartridge 5.

Referring to FIG. 6B, when the center of gravity of the ink cartridge 5 reaches a position in rear, in the mounting direction, of the border between the first surface 84*a* and the second surface 84*b*, the ink cartridge 5 tilts onto the second surface 84*b* due to the gravitational force operating on the cartridge at the center of gravity as shown in FIG. 3. That is, a portion of the ink cartridge 5 in rear, in the mounting direction, of the center of gravity moves toward the second surface 84*b* due to the gravitational force, while a portion of the ink cartridge 5 in front, in the mounting direction, of the center of gravity moves upward. When the ink cartridge 5 tilts, the projection 38 may contact the top plate 83 of the cartridge-housing chamber 80. Then, a frictional force may be produced at the contact point between the projection 38 and the top plate 83. This frictional force may absorb some of the kinetic energy of the ink cartridge 5 produced by the urging forces of the springs 54 and 64, which may reduce movement of the ink cartridge 5 in the demounting direction. Ultimately, the kinetic energy becomes zero, whereby the ink cartridge 5 stops moving in the cartridge-housing chamber 80. In this manner, chances of the ink cartridge 5 jumping out of the cartridge mounting portion 7 are reduced.

As described above, with respect to FIG. 3, because of the provision of the grip 42 at an upper rear portion, in the mounting direction, of the cartridge body 30, the ink cartridge 5 positioned in the mounted position in the cartridge mounting portion 7 may have its center of gravity at a position in rear, in the mounting direction, of the first center line of the ink cartridge 5 and above the second center line of the ink cartridge 5. Moreover, the center of gravity of the ink cartridge 5 may be positioned at a position in rear, in the mounting direction, of the theoretical center of gravity of the ink cartridge 5 as previously described. Therefore, even when the length of the second surface 84*b* in the second direction is short and the distance the ink cartridge 5 moves in the demounting direction is short, the ink cartridge 5 may tilt. Accordingly, the length of the first surface 84*a* of the bottom plate 84 in the first direction may be made relatively long. Therefore, when a user intends to mount the ink cartridge 5 to the cartridge mounting portion 7, the user readily may mount the ink cartridge 5 in the mounting direction by moving the ink cartridge 5 along the first surface 84*a*.

In most cases, the ink cartridge 5 may be demounted from the cartridge mounting portion 7 and is replaced with a new ink cartridge 5 when the amount of ink remaining in the ink chamber 31 becomes small. Therefore, it is acceptable that the center of gravity of the ink cartridge 5 be at the above-described position at least when the ink cartridge 5 is empty, that is, when there is no ink in the ink cartridge 5. Nevertheless, considering a case where the ink cartridge 5 is demounted when a relatively large amount of ink is remaining in the ink chamber 31, it is also acceptable that, even if the ink chamber 31 is filled with ink, the ink cartridge 5 have its center of gravity, also taking the weight of the ink into account, at the above-described position.

As described above, with the ink cartridge 5 having its center of gravity at a position as far toward the rear upper side as possible, the ink cartridge 5 easily may tilt even when the distance the ink cartridge 5 moves in the demounting direction is short. Thus, the chances of the ink cartridge 5 jumping out of the cartridge mounting portion 7 may be further reduced. In addition, because the projection 38 positioned far from the center of gravity of the ink cartridge 5 contacts the top plate 83, a frictional force may be produced even when the tilt of the ink cartridge 5 is not too large.

Moreover, because the urging force of the spring 64 of the air communication portion 33 is greater than the urging force of the spring 54 of the ink supply portion 32 when the ink cartridge 5 is positioned in the mounted position in the cartridge mounting portion 7 of the holder 10, the ink cartridge 5 readily may tilt. That is, because the urging force applied to an upper portion of the front end, in the mounting direction, of the ink cartridge 5 may be greater than the urging force applied to a lower portion of the front end, in the mounting direction, of the ink cartridge 5, the ink cartridge 5 readily may tilt in such a manner that the front-side portion, in the mounting direction, of the ink cartridge 5 moves upward. Thus, chances of the ink cartridge 5 jumping out of the cartridge mounting portion 7 are further reduced.

If the tilt of the second surface 84*b* toward the downward vertical direction is relatively large, i.e., if the angle $\theta 1$ formed between the second direction and the downward vertical direction is relatively small and the tilt of the ink cartridge 5 is therefore large, the ink cartridge 5 may stop moving only by the projection 38 coming into contact with the top plate 83.

In an embodiment, the kinetic energy may be reduced by a frictional force produced at the contact point when the ink cartridge 5 is tilted due to energy produced by gravity. Therefore, this embodiment may be realized such that each of the mounting direction and the demounting direction is a substantially horizontal direction, such that the direction in which the ink cartridge 5 moves with the kinetic energy may be substantially perpendicular to the downward vertical direction in which the ink cartridge 5 moves due to the gravitational force. Nevertheless, in another embodiment, each of the mounting and demounting directions may not be a horizontal direction and may be angled with respect to a horizontal direction.

Various additional embodiments are described herein. Elements having configurations identical with those in the above-described embodiment will be denoted by the same reference numerals, and the description thereof is omitted.

In the above-described embodiment, the projection 38 at the upper end of the front-end face, in the mounting direction, of the cartridge body 30 of the ink cartridge 5 tilted onto the second surface 84*b* may contact the top plate 83 and may produce a frictional force. Nevertheless, in another embodiment, the projection 38 may be distant from the top plate 83 and may not contact the top plate 83. For example, a contacting member, such as a stick, that is configured to be able to contact the projection 38 when the ink cartridge 5 tilts, may be positioned in the cartridge mounting portion 7.

Figure 7:
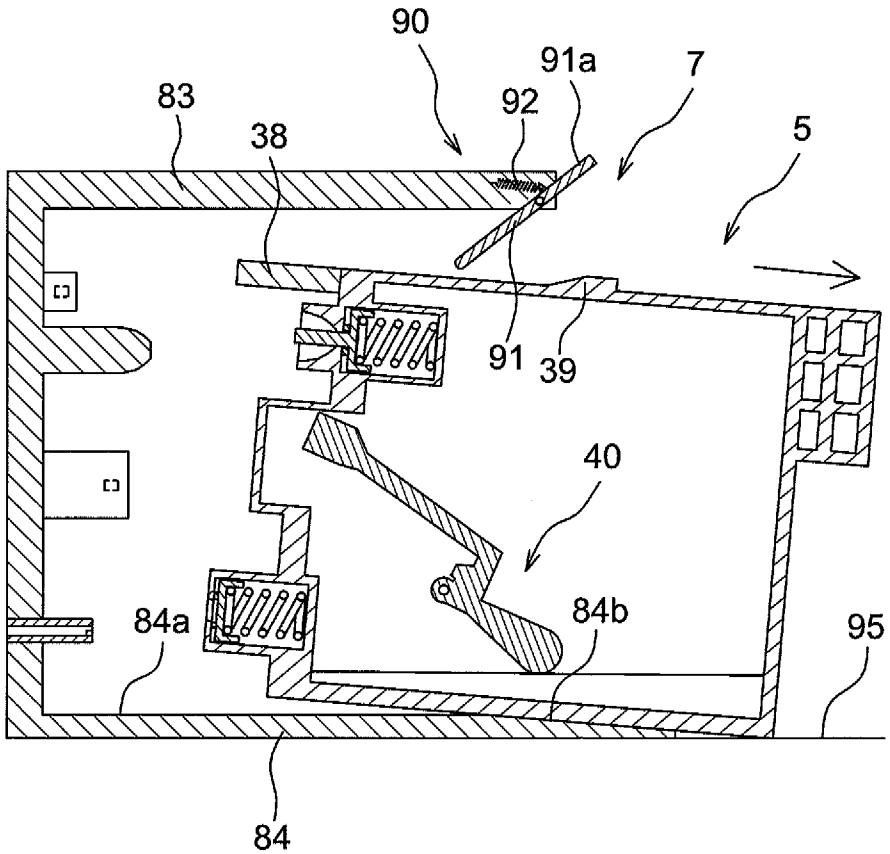
FIG. 7 is a cross-sectional view of an ink supply system taken along a plane that is parallel to the mounting direction and perpendicular to the horizontal plane, according to another embodiment of the invention.
Figure 8A:
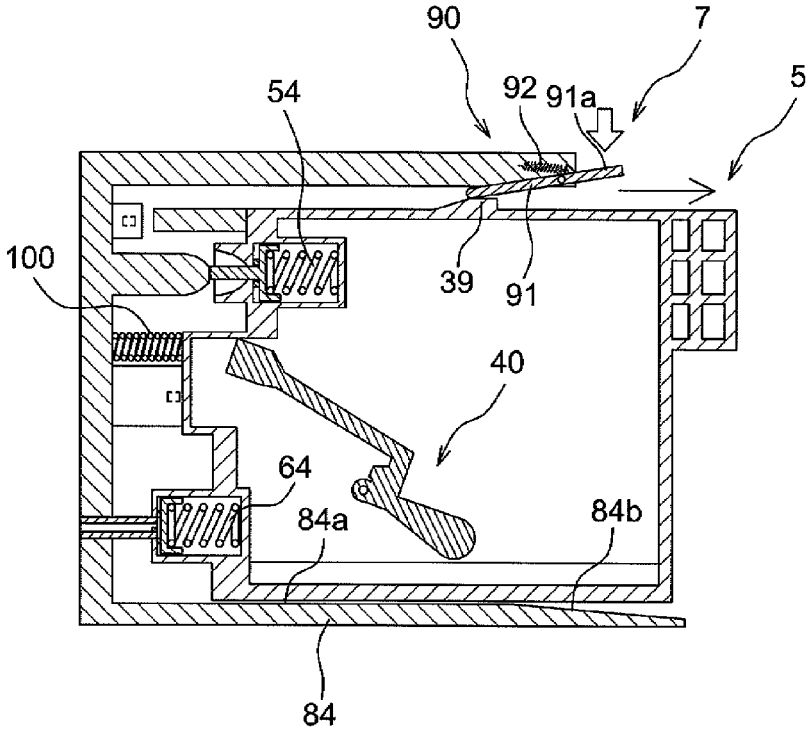
FIG. 8A is a cross-sectional view of the ink supply system taken along a plane that is parallel to the mounting direction and perpendicular to the horizontal plane immediately after a locked ink cartridge is released, according to yet another embodiment of the invention.
Figure 8B:
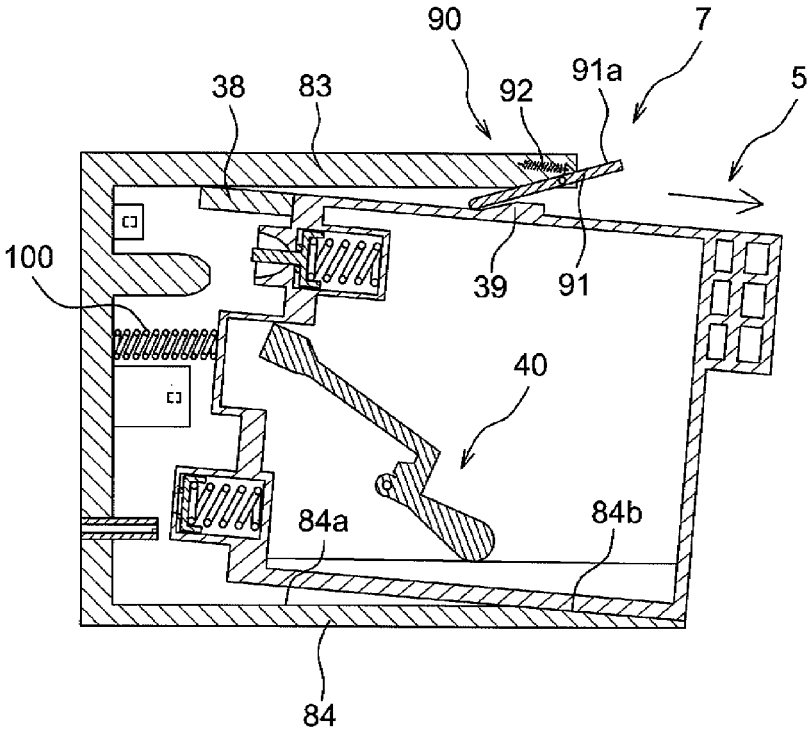
FIG. 8B is another cross-sectional view of the ink supply system taken along a plane that is parallel to the mounting direction and perpendicular to the horizontal plane some time after the locked ink cartridge is released, according to yet another embodiment of the invention.

Referring to FIG. 7, in another embodiment, when the ink cartridge 5 tilted onto the second surface 84*b* moves along the second surface 84*b*, the bottom of the rear-end face, in the mounting direction, of the cartridge body 30 may contact a surface 95, e.g., of a table, on which the printer 1 may be placed. Accordingly, a frictional force may be produced at the contact point between the bottom of the rear-end face of the cartridge body 30 and the surface 95. The frictional force may reduce the kinetic energy of the ink cartridge 5. Thus, chances of the ink cartridge 5 jumping out of the cartridge mounting portion 7 are reduced. The surface 95 may not be limited to a surface of the table, and may be a surface of the printer 1 or any other suitable surface.

In the above-described embodiment, the projection 38 of the ink cartridge 5 may contact the top plate 83. In another embodiment, however, projection 38 may be omitted, and the top face 30*a* of the cartridge body 30 may contact the top plate 83.

In the above-described embodiment, the grip 42 of the ink cartridge 5 may comprise the plurality of ribs 42*a* with spaces between the ribs 42*a*. In another embodiment, the grip 42 may be filled with resin with almost no spaces provided within. In such a case, deformation of the grip 42 may be further suppressed, and the center of gravity of the ink cartridge 5 may be further shifted toward the rear side in the mounting direction.

In the above-described embodiment, the ink cartridge 5 may have its center of gravity at an upper rear position of the ink cartridge 5 because of the weight of the grip 42. In another embodiment, the ink cartridge 5 may not have the grip 42, but may comprise more ribs positioned in an upper rear portion of the ink chamber 31, such that the ink cartridge 5 may have the center of gravity at an upper rear position of the ink cartridge 5.

The tilt of the second surface 84*b* is changeable, according to need, with the magnitudes of the urging forces applied by the springs 54 and 64. For example, if the urging forces applied by the springs 54 and 64 increase, the kinetic energy of the ink cartridge 5 also may increase. Therefore, to increase the frictional force produced when the ink cartridge 5 tilts and comes into contact with the top plate 83, the tilt of the second surface 84*b* may be designed to be angled more toward the downward vertical direction.

While the urging force of the spring 64 of the air communication portion 33 is greater than the urging force of the spring 54 of the ink supply portion 32 when the ink cartridge 5 is positioned in the mounted position in the cartridge mounting portion 7 of the holder 10, in another embodiment, the urging force of the spring 64 may be substantially equal to the urging force of spring 54.

In another embodiment, the urging member that may be configured to urge the ink cartridge 5 mounted in the mounted position in the cartridge mounting portion 7 in the demounting direction may be positioned in the cartridge mounting portion 7, not in the ink cartridge 5. For example, referring to FIGS. 8A and 8B, in yet another embodiment, the cartridge mounting portion 7 may comprise a spring 100 configured to push out the ink cartridge 5, such that that a user may easily remove the ink cartridge 5 from the cartridge mounting portion 7.

The above embodiments describe an ink supply system that supplies ink to an inkjet head of an inkjet printer. Nevertheless, the invention also may be applied to liquid supply systems used in various technical fields that supply liquid to destination devices.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid supply system comprising:

a liquid cartridge comprising a liquid chamber configured to store liquid therein;

a cartridge mounting portion, wherein the liquid cartridge is configured to be removably mounted to the cartridge mounting portion in a mounting direction; and an urging member positioned in one of the liquid cartridge and the cartridge mounting portion and configured to urge the liquid cartridge in a demounting direction opposite to the mounting direction when the liquid cartridge is positioned in a mounted position in the cartridge mounting portion, wherein the liquid cartridge is configured to supply liquid stored in the liquid chamber to the cartridge mounting portion in the mounted position, wherein the cartridge mounting portion comprises:

a bottom plate comprising:

a first surface extending from a front end of the first surface to a rear end of the first surface, in a first direction parallel to the demounting direction, wherein the front end of the first surface is positioned more forward than the rear end of the first surface, in the mounting direction, and the first surface is configured to support the liquid cartridge; and a second surface that borders the first surface and extends from the rear end of the first surface in a second direction, wherein an angle formed between the second direction and a downward vertical direction is less than an angle formed between the first direction and the downward vertical direction, and the second surface extends below the first surface.

2. The liquid supply system of claim 1, wherein a center of gravity of the liquid cartridge is located in rear of a particular center line of the liquid cartridge in the mounting direction, when the liquid cartridge is positioned in the mounted position, and wherein the particular center line is substantially perpendicular to the mounting and demounting directions and intersects a center of a dimension of the liquid cartridge in the mounting and demounting directions.

3. The liquid supply system of claim 2, wherein the center of gravity of the liquid cartridge is positioned above a further center line of the liquid cartridge when the liquid cartridge is positioned in the mounted position, wherein the further center line is substantially perpendicular to a vertical direction and intersects a center of a dimension of the liquid cartridge in the vertical direction.

4. The liquid supply system of claim 2, wherein the center of gravity of the liquid cartridge is positioned above a further center line of the liquid cartridge when the liquid cartridge is positioned in the mounted position, wherein the further center line is substantially perpendicular to the particular center line and intersects a center of a dimension of the liquid cartridge in a direction perpendicular to the mounting and demounting directions.

5. The liquid supply system of claim 3, wherein the liquid cartridge comprises:

a cartridge body comprising the liquid chamber formed therein; and a grip, wherein the grip extends in the demounting direction from an upper portion of a rear end, in the mounting direction, of the cartridge body when the liquid cartridge is positioned in the mounted position, wherein the grip comprises a plurality of ribs positioned therein, wherein the ribs are configured to suppress deformation of the grip when an external force is applied to the grip.

6. The liquid supply system of claim 4, wherein the liquid cartridge comprises:

a cartridge body comprising the liquid chamber formed therein; and a grip, wherein the grip extends in the demounting direction from an upper portion of a rear end, in the mounting direction, of the cartridge body when the liquid cartridge is positioned in the mounted position, wherein the grip comprises a plurality of ribs positioned therein, wherein the ribs are configured to suppress deformation of the grip when an external force is applied to the grip.

7. The liquid supply system of claim 1, wherein a center of gravity of the liquid cartridge is positioned in rear of a theoretical center of gravity of the liquid cartridge when the liquid cartridge is positioned in the mounted position, wherein the theoretical center of gravity is calculated by assuming that the liquid cartridge has a homogeneous density over an entirety thereof.

8. The liquid supply system of claim 1, wherein the liquid cartridge comprises:

a supply portion configured to supply liquid stored in the liquid chamber to an outside of the liquid cartridge; and a communication portion configured to establish fluid communication between the liquid chamber and the outside of the liquid cartridge, wherein the supply portion and the communication portion are positioned at a front end of the liquid cartridge in the mounting direction, and the communication portion is positioned above the supply portion when the liquid cartridge is positioned in the mounted position, and wherein each of the supply portion and the communication portion comprises a valve mechanism comprising a spring, the urging member comprises the supply portion spring and the communication portion spring, and an urging force of the communication portion spring is greater than an urging force of the supply portion spring when the liquid cartridge is positioned in the mounted position.

9. The liquid supply system of claim 1, wherein each of the mounting direction and the demounting direction is a substantially horizontal direction.

10. The liquid supply system of claim 1, wherein the liquid cartridge comprises:

a bottom surface extending in the mounting direction;

a front surface facing the mounting direction; and a supply portion positioned at the front surface and configured to supply liquid stored in the liquid chamber to an outside of the liquid cartridge, wherein the first surface is configured to contact the bottom surface of the liquid cartridge in the mounted position.

11. The liquid supply system of claim 10, further comprising a locking mechanism configured to lock the liquid cartridge in the mounted position against an urging force of the urging member applied to the liquid cartridge, wherein the second surface is configured to contact the bottom surface of the liquid cartridge when the liquid cartridge locked by the locking mechanism is released, and wherein when the liquid cartridge is released, the liquid cartridge is urged by the urging member to move in the demounting direction on the first surface and tilts onto the second surface due to a gravitational force operating on the liquid cartridge.

12. The liquid supply system of claim 11, wherein the liquid cartridge comprises a first contact portion, positioned at an upper end of the liquid cartridge when the liquid cartridge is in the mounted position, and the cartridge mounting portion comprises a second contact portion configured to come into contact with the first contact portion of the liquid cartridge when the liquid cartridge locked by the locking mechanism is released.

13. The liquid supply system of 12, wherein the cartridge mounting portion comprises a top plate positioned opposite the bottom plate, and the top plate comprises the second contact portion.

14. The liquid supply system of claim 12, wherein the liquid cartridge comprises:

a cartridge body comprising the liquid chamber formed therein; and a projection, wherein the projection extends in the mounting direction from an upper portion of the front surface of the cartridge body when the liquid cartridge is positioned in the mounted position, and wherein the projection comprises the first contact portion.

15. The liquid supply system of claim 10, wherein the first surface is configured such that the bottom surface of the liquid cartridge slides on the first surface in the mounting direction when the liquid cartridge is being mounted to the cartridge mounting portion.

16. The liquid supply system of claim 1, wherein a length of the first surface in the first direction is greater than a length of the second surface in the second direction.

17. A liquid supply system comprising:

a liquid cartridge comprising a liquid chamber configured to store liquid therein;

a cartridge mounting portion, wherein the liquid cartridge is configured to be removably mounted to the cartridge mounting portion in a mounting direction; and an urging member positioned in one of the liquid cartridge and the cartridge mounting portion and configured to urge the liquid cartridge in a demounting direction opposite to the mounting direction when the liquid cartridge is positioned in a mounted position in the cartridge mounting portion, wherein the liquid cartridge is configured to supply liquid stored in the liquid chamber to the cartridge mounting portion in the mounted position, wherein the cartridge mounting portion comprises:

a bottom plate comprising:

a first surface extending from a front end of the first surface to a rear end of the first surface, in a first direction parallel to the demounting direction, wherein the front end of the first surface is positioned more forward than the rear end of the first surface, in the mounting direction, and the first surface is configured to support the liquid cartridge; and a second surface that borders the first surface and extends from the second end of the first surface in a second direction, wherein an angle formed between the second direction and a downward vertical direction is less than an angle formed between the first direction and the downward vertical direction, wherein the liquid cartridge comprises:

a supply portion configured to supply liquid stored in the liquid chamber to an outside of the liquid cartridge; and a communication portion configured to establish fluid communication between the liquid chamber and the outside of the liquid cartridge, wherein the supply portion and the communication portion are positioned at a front end of the liquid cartridge in the mounting direction, and the communication portion is positioned above the supply portion when the liquid cartridge is positioned in the mounted position, and wherein each of the supply portion and the communication portion comprises a valve mechanism comprising a spring, the urging member comprises the supply portion spring and the communication portion spring, and an urging force of the communication portion spring is greater than an urging force of the supply portion spring when the liquid cartridge is positioned in the mounted position.

* * * * *